US005452826A

United States Patent [19]

Stern

[11] Patent Number: 5,452,826

[45] Date of Patent: Sep. 26, 1995

[54] PORTIONING ARRANGEMENT FOR DISPENSING PORTIONS OF LIQUID FOODSTUFF FROM A FOODSTUFF CONTAINER

[75] Inventor: Leif E. Stern, Lomma, Sweden

[73] Assignee: Asept International AB, Lund, Sweden

[21] Appl. No.: 295,294

[22] Filed: Aug. 24, 1994

[30] Foreign Application Priority Data

Sep. 7, 1993 [SE] Sweden ..... 9302876

[51] Int. Cl.[6] ..... B65D 37/00

[52] U.S. Cl. ..... 222/207; 222/211; 222/214

[58] Field of Search ..... 222/207, 209, 222/212, 214, 383, 105, 211

[56] References Cited

U.S. PATENT DOCUMENTS

| | | | |
|---|---|---|---|
| 3,987,938 | 10/1976 | Cooprider et al. | 222/209 |
| 3,995,774 | 12/1976 | Cooprider et al. | 222/207 |
| 4,138,038 | 2/1979 | Grogan | 222/207 |
| 4,155,487 | 5/1979 | Blake | 222/207 |
| 4,204,614 | 5/1980 | Reeve | 222/207 X |
| 4,515,294 | 5/1985 | Udall | 222/207 X |
| 4,892,231 | 1/1990 | Ball | 222/207 |
| 5,099,885 | 3/1992 | Nilsson | 222/207 X |
| 5,267,673 | 12/1993 | Crosnier et al. | 222/321 |

FOREIGN PATENT DOCUMENTS

| | | |
|---|---|---|
| 13691 | 8/1980 | European Pat. Off. . |
| 097736 | 1/1984 | European Pat. Off. . |
| 144879 | 6/1985 | European Pat. Off. . |
| 222605 | 5/1987 | European Pat. Off. . |
| 253577 | 1/1988 | European Pat. Off. . |
| 3347629 | 9/1984 | Germany . |
| 676227 | 12/1990 | Sweden . |

*Primary Examiner*—Kevin P. Shaver
*Attorney, Agent, or Firm*—Tarolli, Sundheim & Covell

[57] ABSTRACT

Portioning arrangement for dispensing portions of liquid foodstuff (2) from a foodstuff container, where the portioning device exhibits a portioning housing which exhibits a holding part (7) and a portioning device (8) attachable to this in such a way that the holding part (7) and the portioning device (8) together form a portioning chamber (9) and where the portioning device (8) is arranged to allow foodstuff (2) to be drawn by suction out of the foodstuff container and into the portioning chamber (9) and dispensed from it, principally on to food such as a hamburger or the like. In order to be able to quickly and effectively clean this portioning arrangement (1) internally by dismantling only a small number of parts without tools, the portioning device (8) is designed as a bung-like part (24) which is intended to be inserted into a space (23) intended for the purpose in the holding part (7) so that the bung-like part (24) plugs with a seal and sits securely in said space (23).

17 Claims, 5 Drawing Sheets

PORTIONING ARRANGEMENT FOR DISPENSING PORTIONS OF LIQUID FOODSTUFF FROM A FOODSTUFF CONTAINER

BACKGROUND OF THE INVENTION

The present invention relates to a portioning arrangement for dispensing portions of liquid foodstuff from a foodstuff container which is placed in an outer container, where the liquid foodstuff consists principally of a dressing containing coarse, solid constituents such as, for example, pieces of vegetable in which the portioning arrangement exhibits a portioning housing which exhibits a holding part through which the portioning housing is mounted on the outer container, where a portioning device is arranged in such a way on the holding part that the holding part and the portioning device together form a portioning chamber, where an opening device is arranged on the outer container for operating the portioning device such that foodstuff is drawn by suction out of the foodstuff container and into the portioning chamber and from it, principally on to food such as a hamburger or the like, and where a non-return valve is provided to prevent return flow of foodstuff from the portioning chamber to the foodstuff container through an inlet opening and another non-return valve is provided to prevent flow of foodstuff and/or air into the portioning chamber via an outlet opening.

Portioning arrangements of the above type are already known from e.g. EP, A2, 0 144 879, but they are not intended for dispensing foodstuff and there is therefore no need for quick dismantling and cleaning thereof after daily use, which for hygienic reasons is an absolute requirement when dispensing foodstuff.

SUMMARY OF THE INVENTION

The purpose of the present invention is to eliminate this drawback and achieve a portioning arrangement with a small number of parts to be dismantled, cleaned and re-assembled and where this can be done with simple manual actions. This is achieved according to the invention.

Since the fixing part of the bung-like part can be located in an inner space in the holding part so that it engages inner walls in said space, the holding part and the bung-like part can be sized or dimensioned such that they are easy to dismantle for individual cleaning and thereafter as easy to re-assemble. Despite this dimensioning of the holding part and the bung-like part, it is easy to ensure that the sealing pressure between said parts momentarily increases during dispensation in order to withstand or better withstand the inner pressure thereby generated, namely by bringing the fixing part to strive to dilate or expand in radial direction towards the inner walls when the bung-like part is stressed or influenced by the operating device.

BRIEF DESCRIPTION OF THE DRAWINGS

The invention will be explained in more detail below, with reference to the attached drawings, on which

DESCRIPTION OF THE PREFERRED EMBODIMENT

Figure 1:
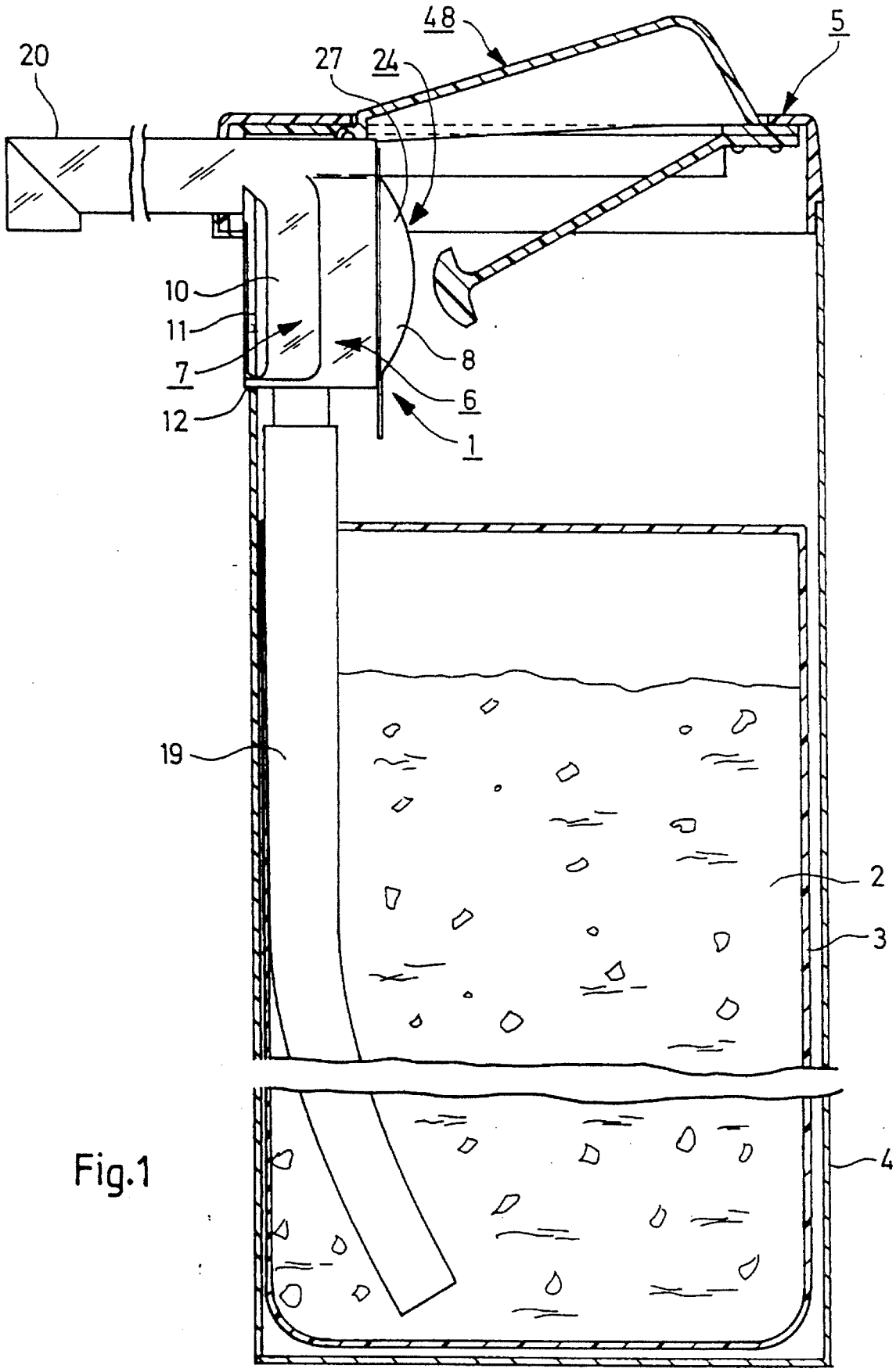
FIG. 1 illustrates a portioning arrangement according to the invention with a side view and arranged in an outer container that is shown in section.
Figure 2:
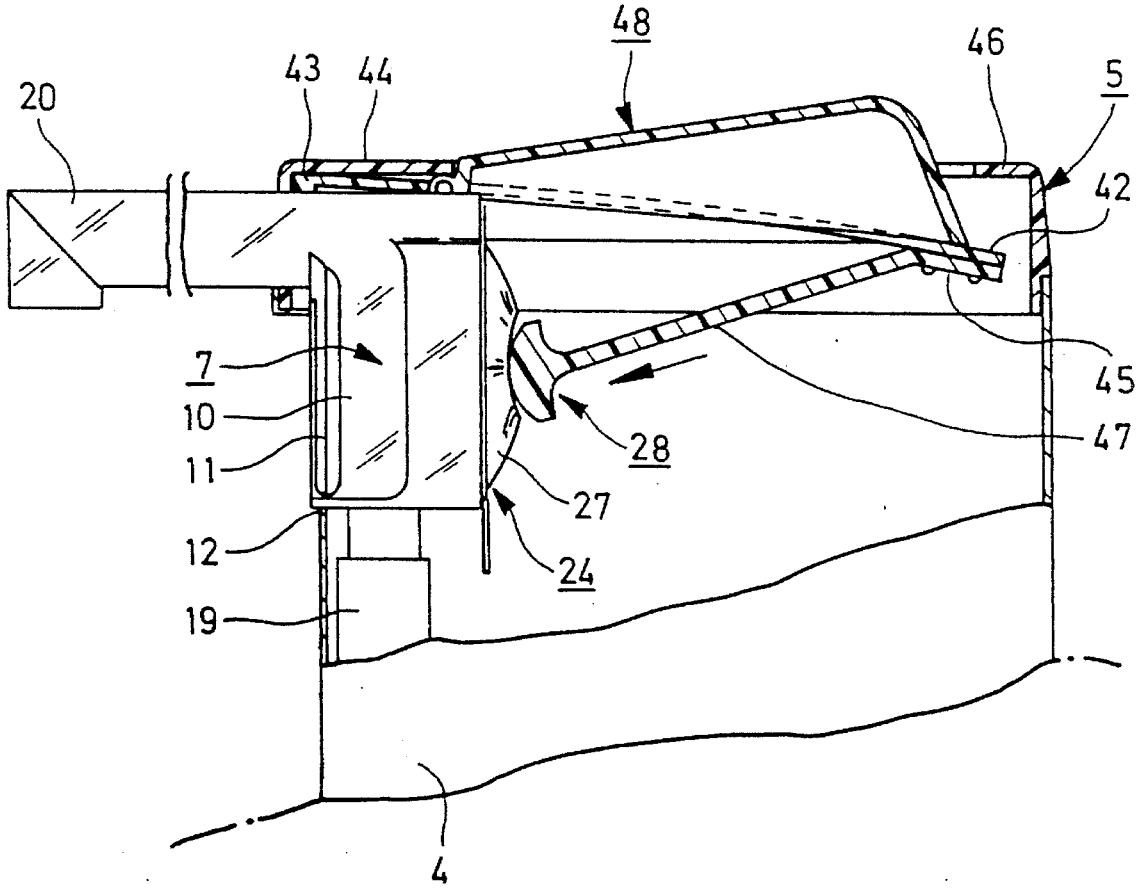
FIG. 2 illustrates the portioning arrangement according to FIG. 1 during portioning.

The portioning arrangement 1 illustrated in the drawings is intended to dispense liquid foodstuff 2 from a foodstuff container 3 and principally to food such as a hamburger or the like. The liquid foodstuff consists primarily of dressing containing coarse, solid components such as pieces of vegetable, for instance, but the foodstuff can of course be of another type.

The foodstuff container 3 is chiefly placed in an outer container 4 with a lid 5.

The portioning arrangement 1 exhibits a portioning housing 6 which consists of a holding part 7, which is intended to securely hold a portioning device 8, where the holding part 7 and the portioning device 8 together form a portioning chamber 9.

The holding part 7 has a front part 10 with two external fixing slots 11 and this front part 10 can be guided down into a recess 12 at the top of the front wall of the outer container 4 so that vertical edge parts that form the recess 12 engage in the fixing slots 11. In this way the edge parts securely hold the holding part 7 at the outer container 4 and the holding part 7 can be attached to the outer container 4 by being guided down into the recess 12 and removed from the outer container 4 by being pulled up out of recess 12.

Internally, the front part 10 of holding part 7 forms an inner part 13 of the portioning chamber 9 and this inner part 13 exhibits a lower wall part 14 with an inlet opening 15 via which foodstuff 2 can flow into portioning chamber 9. The inner part 13 also exhibits an upper wall part 16 with an outlet opening 17 via which foodstuff 2 can flow out of portioning chamber 9.

The front part 10 of holding part 7 is principally elongated and at its lower wall part 14 a downward-directed piece of pipe 18 is arranged. To this can be connected a tube 19, which is intended to project down into the foodstuff container so that foodstuff 2 can flow via tube 19, piece of pipe 18 and inlet opening 15 into portioning chamber 9.

At the top of holding part 7 there is arranged a dispensing pipe 20, the inside of which communicates via outlet opening 17 with portioning chamber 9 and which is intended to dispense foodstuff from portioning chamber 9 to, for example, some food (not shown).

In addition, holding part 7 exhibits a rear part 21 that has essentially cylindrical internal walls 22 to form an essentially cylindrical space 23 for the portioning device 8. Into this cylindrical space 23, the portioning device 8 in the form of a bung-like part 24 can be inserted in such a way that it seals and sits securely in space 23. This bung-like part 24 can be inserted manually in the said space 23 so that it sits securely in space 23 by frictional forces arising between it and the inner walls 22 with which it is in contact, essentially without the need for separate fixing devices to achieve this holding. In addition, the bung-like part 24 can be withdrawn manually from the said space 23, essentially without the need to use tools for this, whereby the portioning chamber 9 is opened so that it can easily be cleaned internally.

The bung-like part 24 exhibits essentially a cylindrical or mainly cylindrical fixing part 25 of elastic material. This has an open end part 26 but is closed at the other end by an end wall 27 of elastic material. The bung-like part 24 can be positioned in such a way in the space 23 that foodstuff 2 can enter the fixing part 25 and up to the end wall 27, which can thereby directly influence the foodstuff 2 to be drawn by suction into the portioning chamber 9 or be dispensed from it when the end wall is subject to portioning motions PR by means of an operating device 28.

Figure 3:
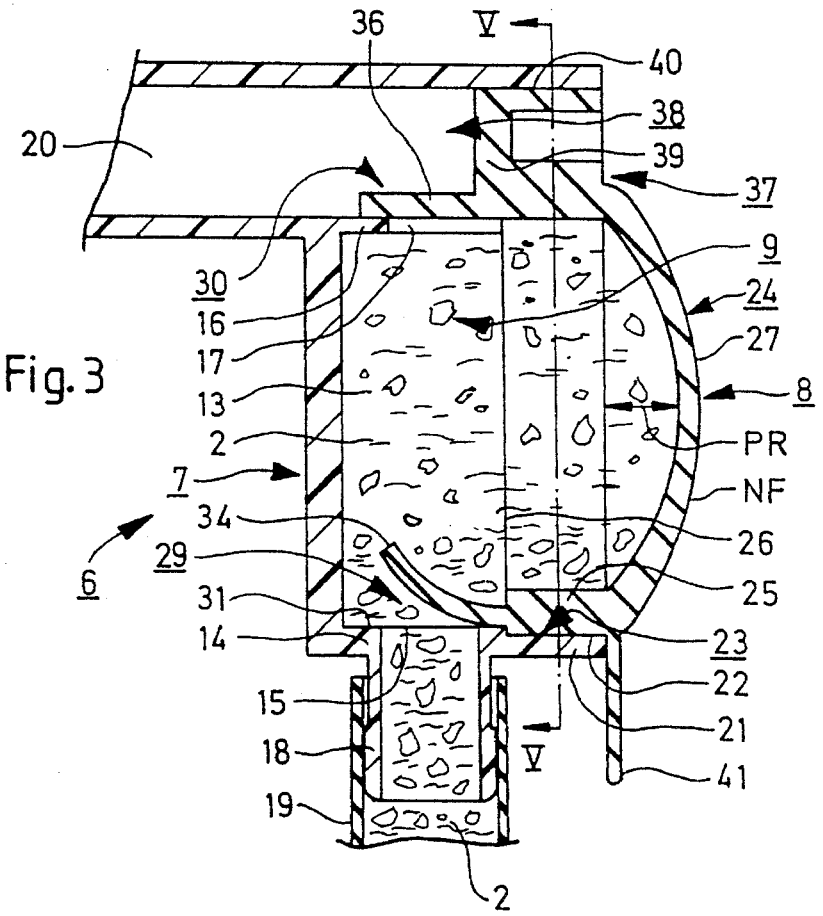
FIG. 3 illustrates a vertical section through parts of the portioning arrangement according to FIG. 1 and during a drawing-in operation.

In the non-operated state, the end wall 27 has essentially a normal shape NF (see FIG. 3), convex in the axial direction relative to the fixing part 25. In addition, the end wall 27 is shaped so that its wall thickness increases from the central parts thereof in a direction radially outwards towards such outer parts as connect with the cylindrical or mainly cylindrical fixing part 25. As a result of this, the end wall 27 exerts increased resistance the more it is pressed in by the operating device 28 and or it is ensured that the end wall 27 does not remain in the pressed-in position IL.

Further, the shape and elasticity exhibited by the end wall 27 are such that it returns from its pressed-in position IL to its normal shape NF and this return motion gives rise to negative pressure in the portioning chamber 9, whereby foodstuff 2 is drawn from the foodstuff container 3 and into the portioning chamber 9.

Further, the bung-like part 24 is shaped so that the fixing part 25 is pressed in the radial direction outwards from surrounding walls 22 when the end wall 27 is pressed in towards its pressed-in position IL, whereby the fixing part 25 applies greater pressure to the surrounding inner walls 22 during the said position change on the end wall 27 and the sealing effect between the said walls 22 and the fixing part 25 increases. Moreover, the friction increases when this happens, and with it the holding effect between the walls 22 and the fixing part 25.

The portioning arrangement 1 exhibits a non-return valve 29 which is intended to prevent return flow of foodstuff 2 from the portioning chamber 9 in the direction towards the foodstuff container 3 when the pressure in the portioning chamber 9 is increased. The portioning arrangement 1 also exhibits a non-return valve 30 which is intended to prevent the return flow of foodstuff and/or air from the dispensing pipe 20 to the portioning chamber 9 when negative pressure is generated in this to draw in foodstuff 2 into it from the foodstuff container 3.

Non-return valves 29 and 30 exhibit valve seats 31 and 32 which are formed by holding part 7. The valve seat 31 of one non-return valve 29 is formed principally of the inside of the lower wall part 14 around the inlet opening 15. The valve seat 32 of the other non-return valve 30 is formed principally of the outside of the upper wall part 16 at the outlet opening 17 in this. The valve body 33 of one non-return valve 29 consists mainly of an elastic tongue 34 on the bung-like part 24. This tongue 34 projects from an end part of the bung-like part 24, principally an end part of fixing part 25 so that the tongue extends over the lower wall part 14 and interacts with valve seat 31. Valve body 35 of the other non-return valve 30 consists principally of an elastic tongue 36 on the bung-like part 24. This tongue 36 projects from an end part of the bung-like part 24, primarily an end part of the fixing part 25 so that the tongue 36 extends over the upper wall part 15 and interacts with valve seat 32.

The bung-like part 24 exhibits principally a position determining and/or holding part 37 and the holding part 7 exhibits at a place at the space 23 a position-determining and/or holding part 38. With the aid of this arrangement, it is achieved that the bung-like part 24 can only be inserted into the space 23 if the bung-like part 24 is aligned so that the part 37 is located in front of and can be inserted in the space 38, ie the bung-like part 24 can only be inserted in the space 23 so that the tongues 34, 36 will take up predetermined positions relative to their valve seats 31, 32.

In addition, the position-determining and/or holding part 37 is principally so designed that it can be made to sit securely in its position-determining and/or holding space 38, which contributes to holding the bung-like part 24 in a firm grip at the holding part 7.

The position-determining and/or holding part 37 is made up primarily of a cylindrical part 39 which is located at the top of fixing part 25 and position-determining and/or holding part 38 is made up primarily of a rear part 40 of the dispensing pipe 20.

The bung-like part 24 and its component parts such as fixing part 25 and end wall 27.and principally also valve bodies 33, 35, and/or position-determining and/or holding part 37 and/or a handle part 41, are principally produced as one unit in the same elastic material, silicone rubber being suitable.

The handle part 41 is principally located at the bottom of fixing part 25 and is intended to facilitate the withdrawal of the bung-like part 24 from space 23.

The operating device 28 arranged on the lid 5 exhibits a spring device 42 which is located under the lid 5 and which, via a front fixing part 43 is attached at a front part 44 of lid 5. The spring device 42 extends exposed from the front fixing part 43 to a rear part 46 of lid 5. Arranged on a rear part 45 of spring device 42 is an operating device 47, which is directed obliquely forward and downward towards the bung-like part 24 and which is intended to impart to this the portioning motions PR. The spring device 42 and/or the operating device 47 is/are arranged to behave as a spring so that operating device 47 does not slide against the bung-like part 24 when the operating device 47 interacts with it. Further, an operating handle 48 is mounted in an articulated manner on the lid 5 and this can interact with the spring device 42 via a hole in the lid 5 so that the spring device 5 is pressed downwards, whereby the operating device 47 is caused to interact with the bung-like part 24. The spring device 42 has essentially such spring properties that it can return to an initial position adjacent to the lid 5 and also return the operating handle 48 to an initial position.

Figure 4:
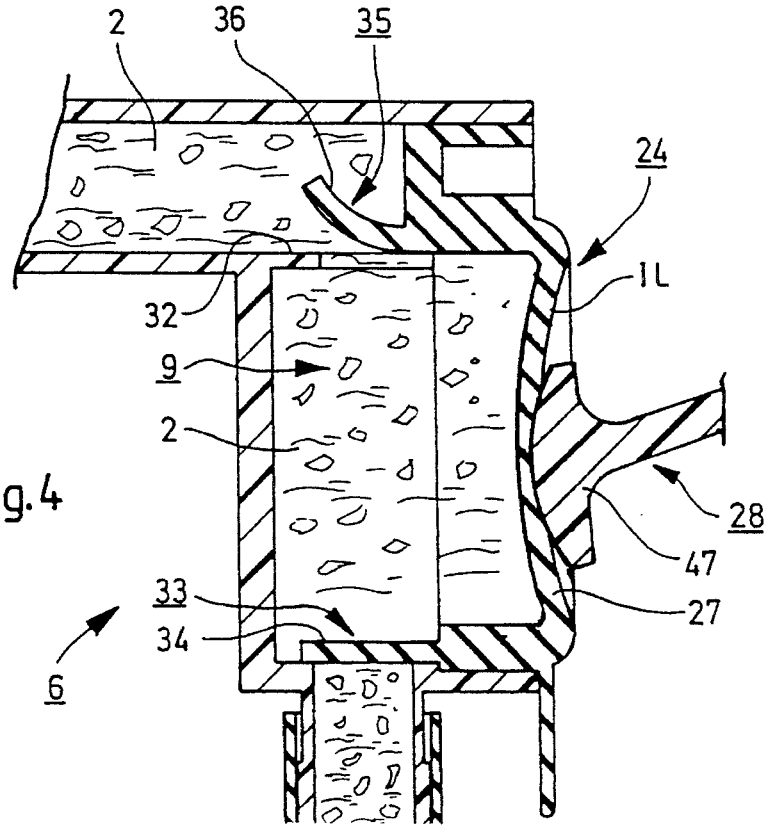
FIG. 4 illustrates a vertical section of the portioning arrangement according to FIG. 3 during a dispensing operation.
Figure 5:
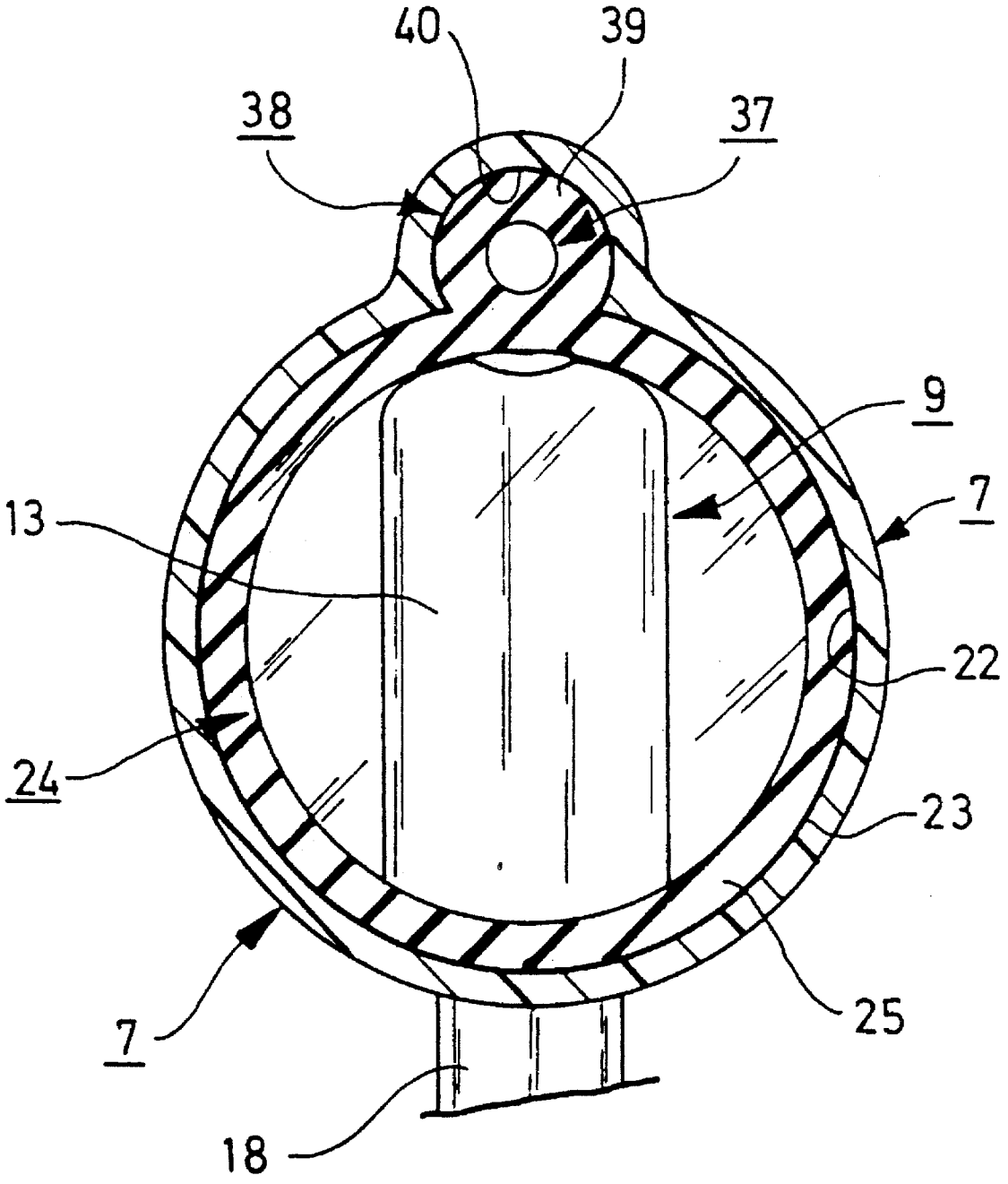
FIG. 5 illustrates a section along the line V-V through the portioning arrangement according to FIG. 3.
Figure 6:
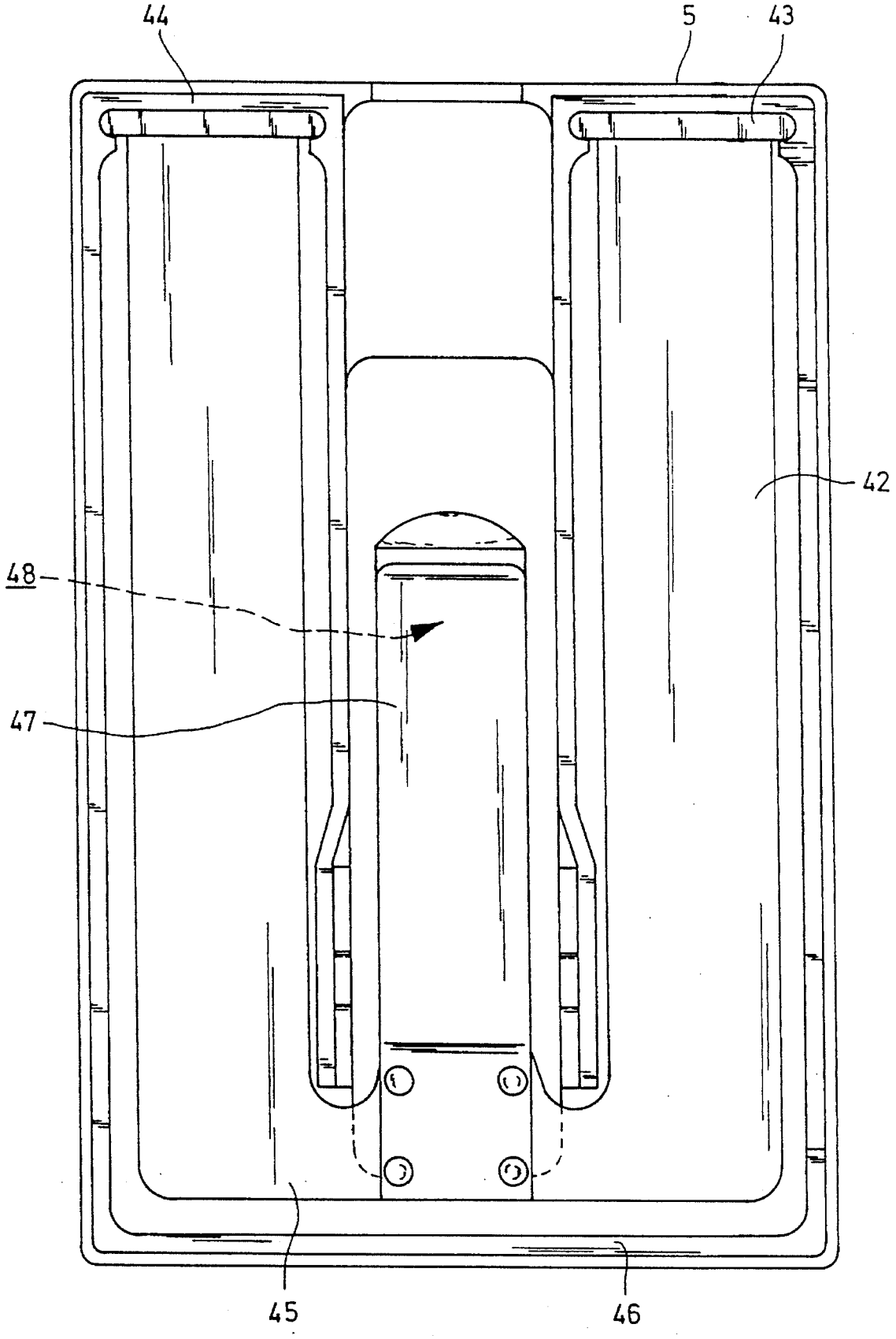
FIG. 6 illustrates a plan view from below of a lid for the outer container according to FIG. 1.

On activation of the end wall 27 to the pressed-in position with the aid of operating device 28, a positive pressure is produced in portioning chamber 9, whereupon the non-return valve 29 closes and the non-return valve 30 opens (FIG. 4) so that foodstuff present in the portioning chamber 9 is dispensed via the outlet opening 17. When the action of operating device 28 on the end wall 27 ceases, the end wall 27 returns to its normal shape NF, thus creating a negative pressure in the portioning chamber 9, whereupon the non-return valve 30 closes and the non-return valve 29 opens (FIG. 3) so that foodstuff 2 is drawn by suction from the foodstuff container 3 into the portioning chamber 9 via the inlet opening 15. After daily use, the portioning arrangement 1 can be cleaned by first pulling off holding part 7 with, attached to it, the bung-like part 24 from the outer container 4, after which the bung-like part 24 is pulled off the holding part 7. Thus there are only two parts 7 and 24 to clean, and there is also easy access to the internal parts of the said parts 7, 24 which have come into contact with foodstuff 2, for cleaning of these internal parts.

The object of the invention is not restricted to the embodiment described above and shown in the drawings, but may vary within the framework of the claims below. So, for example, the fixing part 25 of the bung-like part 24 may exhibit a form other than cylindrical and this applies also to the space 23 intended for it. The bung-like part 24 can also exhibit a different shape in other respects, which is also the case for the holding part 7 and the operating device 28.

At the illustrated embodiment of the portioning device, the space 23 in the holding part 7 and the fixing part 25 of the bung-like part 24 insertable therein are designed such that the fixing part 25 without difficulty can be inserted into the space 23 in which it is retained by engaging the surrounding inner walls 22 and such that the fixing part 25 without difficulty can be pulled out of or withdrawn from the space 23 for dismantling the holding part 7 and the bung-like part 24 when these members are to be cleaned separately. Furthermore, the fixing part 25 is preferably so arranged and/or preferably has such elasticity, that it can be brought to strive to dilate or expand in radial direction towards the inner walls 22 when the end wall 27 is influenced by the operating device 28 for dispensing foodstuff 2 from the portioning chamber 9. Hereby the sealing effect between the fixing part 25 and the inner walls 22 can increase momentarily during dispensation of foodstuff 2 from the portioning chamber 9, and the fixing part 25 can, when the influence from the operating device 28 has ceased, return to its original shape and thus, again be easily removable from the space 23.

I claim:

1. A portioning mechanism (1) for removable connection to a container (4) and for dispensing portions of a liquid foodstuff (2) from a location within the container (4) to a location outside the container (4), said mechanism (1) comprising:

a holding part (7) having: a hollow inner portion (13) for receiving an amount of the liquid foodstuff (2), an inlet opening (15) to said inner portion (13) for directing a flow of the liquid foodstuff from the location within the container (4) into said inner portion (13) and an outlet opening (17) from said inner portion (13) for directing a flow of the liquid foodstuff (2) from said inner portion (13) toward the location outside of the container (4);

a portioning device (8) for removable engagement with said holding part (7) to define a chamber (9) which includes said inner portion (13) and for creating volume changes of said chamber (9) which expel the portions of the liquid foodstuff (2) out of said outlet opening (17) upon actuation of said portioning device (8) and which draws the liquid foodstuff (2) into said chamber (9) through said inlet opening (15) upon deactuation of said portioning device (8);

a first one-way check valve (29) located at said inlet opening (15) for preventing a return flow of the foodstuff (2) from said chamber (9) to the location within the container (4) through said inlet opening (15);

a second one-way check valve (30) located at said outlet opening (17) for preventing a return flow of the foodstuff (2) and/or air into said chamber (9) through said outlet opening (17); and an operating device (28) for actuating said portioning device (8);

said holding part (7) having inner walls (22) which define an open space (23) which opens into said inner part (13), said holding part (7) engaging potions on the container (4);

said portioning device (8) including a bung-like part (24) for removable insertion into said opening space (23) of said holding part (7), said bung-like part (24) having an elastic fixing part (25) for seating engagement with said inner walls (22), and an elastic end wall (27) for engagement by said operating device (28) during an actuating stroke which moves said end wall (27) and decreases the volume of said chamber (9), each of said one-way check valves (29, 30) including an elastic tongue (34, 36) for blocking a respective flow of the liquid foodstuff (2) and a valve seat (31, 32), said bung-like part (24) and said elastic tongues (34, 36) being integrally formed as parts of an integral member;

said holding part (7) having a dispensing pipe (20) which is intended to dispense foodstuff from the portioning chamber (9);

said dispensing pipe (20) having a rear part (40);

said bung-like part (24) having a holding part (37) for location in said rear part (40) of said dispensing pipe (20);

said holding part (37) providing a holding effect for fixing said bung-like part (24) onto said holding part (7) and a position determining effect for said elastic tongues (34, 36) with respect to said valve seats (31, 32).

2. A portioning mechanism as set forth in claim 1, wherein said bung-like part (24) is manually insertable into said open space (23) so that it sits securely in said open space (23) by frictional forces arising between it and said inner walls (22) with which it is in contact, essentially without the need for separate fixing devices to achieve this holding, and said bung-like part (24) is manually removable from said open space (23) by overcoming said frictional forces, essentially without the need to use tools for this, whereby the portioning chamber (9) is opened so that it can easily be cleaned internally.

3. A portioning mechanism as set forth in claim 1, wherein said bung-like part (24) has an open end part (26), and said bung-like part (24) is positioned in said open space (23) in such a way that the liquid foodstuff (2) can enter said fixing part (25) up to said end wall (27), said end wall (27) being subject to portioning motions (PR) in order to produce negative pressure in said chamber (9) and thereby draw in the liquid foodstuff (2) by suction into said chamber (9) and to achieve a positive pressure in said chamber (9) and thus dispense the liquid foodstuff (2) from said chamber (9).

4. A portioning mechanism as set forth in claim 1, wherein said rear part (40) of said dispensing pipe (20) having a position-determining and holding space (38), said holding part (37) consists essentially of a cylindrical part (39) insertable in said position-determining and holding space (38).

5. A portioning mechanism as set forth in claim 1, wherein said fixing part (25) is generally cylindrical and is pressed in the radial direction outwards against said inner walls (22) when said end wall (27) is subjected to a portioning motion (PR) to dispense the liquid foodstuff (2) from said chamber (9).

6. A portioning mechanism as set forth in claim 1, wherein said elastic tongues (34, 36) project from an end part of said fixing part (25).

7. A portioning mechanism as set forth in claim 1, wherein said end wall (27) having a convex shape in an axial direction relative to said fixing part (25) when said end wall (27) is in a non-operated state, said operating device (28) pressing said end wall (27) inward in the axial direction relative to said fixing part (25) to press the liquid foodstuff (2) out of said portioning chamber (9) during the actuating stroke, said end wall (27) returning automatically to the convex shape and drawing the liquid foodstuff (2) by suction from the foodstuff container (3) in the direction of the portioning chamber (9) upon release of said operating device (28) from its operating stroke.

8. A portioning mechanism as set forth in claim 7, wherein said end wall (27) having a wall thickness which increases from a central part of said end wall (27) in directions radially outwards towards an outer part of said end wall (27) for exerting an increased resistance the more it is pressed in by said operating device (28) and for returning to the convex shape upon release of the operating device (28).

9. A portioning mechanism as set forth in claim 1, wherein said fixing part (25) and said end wall (27) are made as one unit of a single elastic material, comprising primarily silicone rubber.

10. A portioning mechanism as set forth in claim 1, wherein said operating device (28) is arranged on a lid (5) attachable to said container (4).

11. A portioning mechanism as set forth in claim 1, wherein said holding part (7) has a front part (10) with fixing slots (11), said front part (10) being capable of being lowered into a recess (12) at the top of the container (4) so that edge parts which form the recess (12) engage in said fixing slots (11) for securely holding said holding part (7) on the container (4).

12. A portioning mechanism as set forth in claim 1, wherein said operating device (28) has a spring device (42) which is located under a lid (5) which, via at least one front fixing part (42), is fixed at a front part (44) of said lid (5) and which extends exposed from the front fixing part (43) backward so that a rear part (45) of said spring device (42) is situated at a rear part of said lid (5), an operating device (47) is arranged on said rear part (45) of said spring device (42), said operating device (47) is directed obliquely forward and downward from said spring device (42) towards said bung-like part (24) and acts upon said bung-like part (24) for imparting portioning motions (PR), said spring device (42) and/or said operating device (47) is/are arranged to behave as a spring so that said operating device (47) interacts with it, an operating handle (48) is arranged to be pressed downwards for pressing on the spring device (42) in the forward/downward direction to cause said operating device (47) to interact with said bung-like part (24), and said spring device (42) has spring properties for causing it to return to an initial position and return the operating handle (48) to an initial position.

13. A portioning mechanism as set forth in claim 1, wherein said holding part (7) and said bung-like part (24) can be dismantled so that said holding part (7) and said bung-like part (24) can be individually cleaned of the liquid foodstuff (2).

14. A portioning mechanism as set forth in claim 1, wherein said holding part (7) and said bung-like part (24) can be removed from said container (4), said bung-like part (24) can be removed from said holding part (7) by being pulled.

15. A portioning mechanism as set forth in claim 1, including a tube (19) for the liquid foodstuff (2), said tube (19) projects down into a foodstuff container (3) in said container (4), said tube (19) can be withdrawn from said foodstuff container (3) when said holding part (7) is removed.

16. A portioning mechanism as set forth in claim 1, wherein said open space (23) and said fixing part (25) being sized such that said fixing part (25) can be inserted into the space (23) and such that said fixing part (24) can be withdrawn from the space (23), and said fixing part (25) expanding in radial directions towards said inner walls (22) when said end wall (27) of said bung-like part (24) is influenced by said operating device (28) for dispensing the liquid foodstuff (2) from said portioning chamber (9).

17. A portioning mechanism (1) for removable connection to a container (4) and for dispensing portions of a liquid foodstuff (2) from a location within the container (4) to a location outside the container (4), said mechanism (1) comprising:

a holding part (7) having: a hollow inner portion (13) for receiving an amount of the liquid foodstuff (2), an inlet opening (15) to said inner portion (13) for directing a flow of the liquid foodstuff from the location within the container (4) into said inner portion (13) and an outlet opening (17) from said inner portion (13) for directing a flow of the liquid foodstuff (2) from said inner portion (13) toward the location outside of the container (4);

a portioning device (8) for removable engagement with said holding part (7) to define a chamber (9) which includes said inner portion (13) and for creating volume changes of said chamber (9) which expel the portions of the liquid foodstuff (2) out of said outlet opening (17) upon actuation of said portioning device (8) and which draws the liquid foodstuff (2) into said chamber (9) through said inlet opening (15) upon deactuation of said portioning device (8);

a first one-way check valve (29) located at said inlet opening (15) for preventing a return flow of the foodstuff (2) from said chamber (9) to the location within the container (4) through said inlet opening (15);

a second one-way check valve (30) located at said outlet opening (17) for preventing a return flow of the foodstuff (2) and/or air into said chamber (9) through said outlet opening (17); and an operating device (28) for actuating said portioning device (8);

said holding part (7) having inner walls (22) which define an opening space (23) which opens into said inner part (13), said holding part (7) having exterior surface portions (11) which engage with surface portions on the container (4) for guided movement of said holding part (7) to a supported location on the container (4) during installation of said holding art (7) onto the container (4) and for guiding a removal movement of said holding part (7) from the container (4), said holding part (7) having no portion which is engaged with the container (4) for preventing removal of said holding part (7) from the container (4) along a path of the removal movement;

said portioning device (8) including a bung-like part (24) for removable insertion into said opening space (23) of said holding part (7), said bung-like part (24) having an elastic fixing part (25) for seating engagement with said inner walls (22), and an elastic end wall (27) for engagement by said operating device (28) during an actuating stroke which moves said end wall (27) and decreases the volume of said chamber (9), each of said one-way check valves (29, 30) including an elastic tongue (34, 36) for blocking a respective flow of the liquid foodstuff (2), said bung-like part (24) and said elastic tongues (34, 36) being integrally formed as parts of an integral member;

said holding part (7) and said bung-like part (24) not having any means which would prevent ready separation of said bung-like part (24) from said holding part (7) to permit separate cleaning of said bung-like part (24) and said holding part (7).

* * * * *